United States Patent [19]

Joubert

[11] Patent Number: 4,622,705

[45] Date of Patent: Nov. 18, 1986

[54] TODDLER BED CONSTRUCTION UTILIZING CRIB CONVERTER KIT

[76] Inventor: Roger D. Joubert, 500 Fontelieu Dr., New Iberia, La. 70560

[21] Appl. No.: 708,391

[22] Filed: Mar. 5, 1985

[51] Int. Cl.[4] ..... A47D 7/00

[52] U.S. Cl. ..... 5/93 R; 5/200 C; 5/296; 5/425

[58] Field of Search ..... 5/9 R, 93 R, 95, 99 C, 5/100, 186 R, 186 B, 189, 193, 196, 200 R, 200 C, 279 C, 279 B, 286, 296, 425; 248/220.1, 300; 52/426

[56] References Cited

U.S. PATENT DOCUMENTS

| | | | |
|---|---|---|---|
| D. 264,773 | 6/1982 | Sutherland | D6/5 |
| 1,380,518 | 6/1921 | Bellig | 248/220.1 |
| 2,266,370 | 12/1941 | Kratky | 5/99 C |
| 2,567,047 | 9/1951 | Arliss | 5/95 |
| 2,648,850 | 8/1953 | Warren | 5/425 |
| 2,677,832 | 5/1954 | Christensen | 5/201 |
| 2,738,540 | 3/1956 | Kramcsak, Jr. | 248/220.1 |
| 2,976,548 | 3/1961 | Maertins | 5/100 |
| 2,979,738 | 4/1961 | Goldberg | 5/100 |
| 3,080,577 | 3/1963 | Atkinson | 5/100 |
| 3,135,973 | 6/1964 | Spencer | 5/100 |
| 3,194,527 | 7/1965 | Gruss | 248/220.1 |
| 3,293,668 | 12/1966 | Auer | 5/425 |
| 3,299,450 | 1/1967 | Gottfried et al. | 5/100 |
| 3,590,403 | 7/1971 | Mixon | 5/100 |
| 3,727,246 | 4/1973 | Germano | 5/282 R |
| 4,126,906 | 11/1978 | Foust | 5/295 |
| 4,148,106 | 4/1979 | Gallien | 5/296 |
| 4,222,136 | 9/1980 | Valentino | 5/443 |
| 4,285,079 | 8/1981 | Hillman | 5/93 R |
| 4,359,793 | 11/1982 | Hosono | 5/100 |
| 4,364,134 | 12/1982 | Marks | 5/200 R |
| 4,525,883 | 7/1985 | Necowitz | 5/93 B |

FOREIGN PATENT DOCUMENTS

| | | | |
|---|---|---|---|
| 636452 | 5/1950 | United Kingdom | 5/426 |
| 815663 | 7/1959 | United Kingdom | 5/507 |

*Primary Examiner*—John E. Murtagh
*Assistant Examiner*—Andrew Joseph Rudy

[57] ABSTRACT

This invention relates to a youth bed construction. More particularly, this invention utilizes the springs and mattresses from a conventional baby crib together with a baby crib conversion kit to build a youth toddler bed.

1 Claim, 4 Drawing Figures

TODDLER BED CONSTRUCTION UTILIZING CRIB CONVERTER KIT

BACKGROUND OF THE INVENTION

This invention relates to a youth bed construction. More particularly, this invention utilizes the springs and mattresses from a conventional baby crib together with a baby crib conversion kit to build a youth toddler bed.

DESCRIPTION OF THE PRIOR ART

It is usually necessary for parents to wait long after a child has learned to walk before providing the child with an adult bed. When this is done, the child initially requires a great deel of adult supervision in getting into and out of the bed. It is also necessary to make sure that the child does not fall out of the bed while sleeping. The initial investment for an adult bed can be substantial when the cost of the springs and mattress is considered. In view of this, it is clearly desirable to construct a toddler bed from a crib so as to enable toddlers to enter and exit their own bed without adult supervision being necessary.

Convertible beds are known per se in the art. For example, U.S. Pat. Nos. 2,677,832; 2,266,370; 3,135,973 and 3,299,450 all relate to convertible beds which can accomodate babies and toddlers. Each of the above inventions, however, require special or multiple sets of springs and mattresses, such requirement being a definite disadvantage.

Guard rails which fit onto conventional beds are also known in the art. Warren (U.S. Pat. No. 2,648,850) and Arliss (U.S. Pat. No. 2,567,047) disclose such apparati.

SUMMARY OF THE INVENTION

In view of the foregoing, it is therefore an object of the present invention to provide a crib conversion kit which utilizes the springs and mattresses of a conventional crib for the construction of a toddler bed.

It is a further object of this invention to provide a simple construction incorporating the guard rail into the design of the bed, much the same as a conventional crib, however, leaving an opening for a child to enter and exit the bed without the lowering and raising of the frame necessary in conventional cribs.

It is still another object of this invention to provide a simple construction which utilizes a conventional baby crib mattress and springs to provide an economical and practical way for providing a bed for toddlers.

Yet, a further object of this invention is to provide a toddler bed which can be shipped in pieces or kit form and assembled by those not particularly mechanically inclined.

These and other objects of the present invention will become apparent to those skilled in the art, from a consideration of the following detailed description taken in consideration with the accompanying drawings, which form a part of the specification, with the understanding, however, that the invention is not confined to strict conformity with the drawings, but may be changed or modified, so long as such changes or modifications make no material departure from the salient features of the invention as expressed in the appended claims.

DESCRIPTION OF THE PREFERRED EMBODIMENTS

Figure 1:
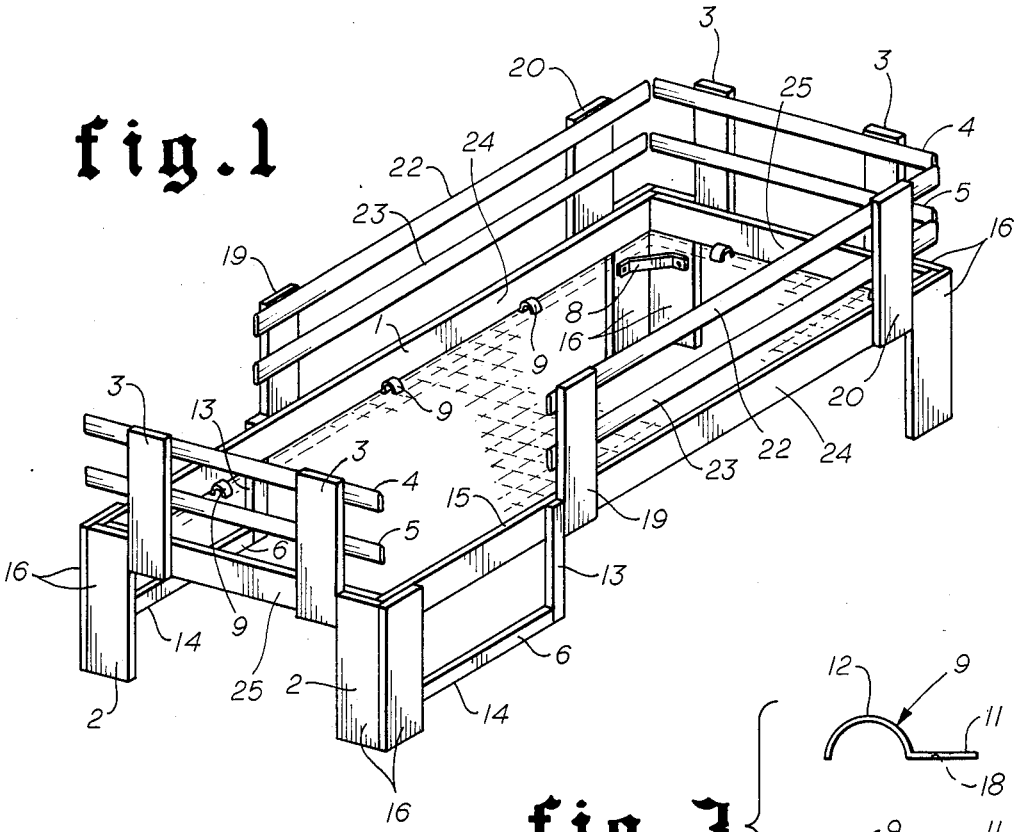
FIG. 1 is a perspective view of a converted crib with side guards and a step constructed in accordance of the provision of the present invention.
Figure 4:
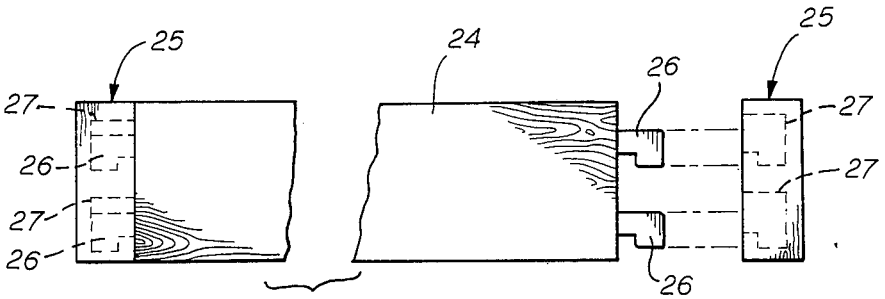
FIG. 4 illustrates the hook-latches and receptacles for assemblying the main frame member.

Referring now to the figures which illustrate the preferred embodiments of the invention, FIG. 1 illustrates the overall bed assembly of a toddler bed construction. A rectangular frame 1 is assembled which consists of two rectangular end members 25 and two substantially longer side members 24. Referring now to FIG. 4, the means for assembling the frame 1 is shown. Each of the side members has flat hook-type latches 26 disposed at either end. The end members 25 have corresponding apertures 27 at either end which accept the latches 26. The apertures are so designed that the openings 27 are large enough to accept the latches 26 and then allow the latches 27 to slide down inside to form a secure connection. The rectangular legs 16 are secured to the end members 24, 25 by conventional means and upon assembly of the main frame members 24, 25 the leg members 16 are secured near the bottom by conventional fastener means such as screws or nails.

Figure 2:
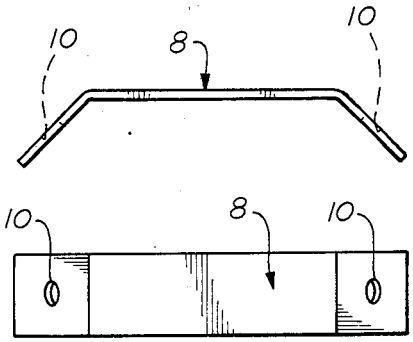
FIG. 2 illustrates the bracket utilized to support the conventional baby crib spring.

Special brackets 8 are used to support the conventional baby crib spring structure as schematically illustrated in FIG. 1. Brackets 8 are shown in FIG. 2. Each bracket consists of three flat surfaces, two of which extend at 45° angles from either end of the center surface. The end surfaces are provided with apertures 10 which accomodate a fastener, such as a nail or screw (not shown), for securing the brackets to the leg members at a distance below the top of the main frame 1 so that the combined height of the conventional baby crib springs and mattress (not shown) extend approximately 1 inch above the main frame 1.

Immediately inside each leg at the head and foot of the frame 1 is a rectangular guard rail support member 3, which is attached to the frame 1 and extends upward. The parallel guard rails 4, 5 are rectangular in shape with the edges rounded and are attached by conventional means to the vertical support members 3. One rail 4 is attached at the top of the support member and the other rail 5 is attached half-way between the upper rail and the main frame.

The side guard rails are constructed in much the same manner as the end rails. One each of vertical support members 19 is attached approximately 16" from the foot on either side of the bed frame 1 and another member 20 is attached substantially at the head and either side of the frame 1. The rails 22, 23 are attached to the vertical support members 19, 20 in the same manner as the end guard rails.

Figure 3:
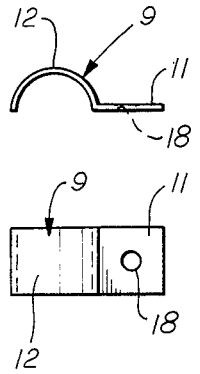
FIG. 3 illustrates the special bracket utilized to stablize the conventional baby crib springs and prevent lateral movement.

FIG. 3 illustrates the special brackets 9 used to stabilize the conventional baby crib spring structure to prevent lateral movement. The bracket 9 consist of a straight flat section 11 and a semi-circular flat section 12. The straight flat section 12 is provided with an apperture 18 which accomodates a conventional fastener such as a nail or screw for attachment to the main frame 1. Two each of the special brackets 9 are attached to the top of each member of the main frame 1 and disposed such that the curved portion 12 is facing inward and the opening in the curve is facing downward so as to fit over the topmost frame element is a conventional baby crib spring.

The steps 6 enable a toddler to enter and exit from either side of the bed without adult supervision. Each step comprises two members 13, 14. One each of members 13 is attached to either side of the main frame 1 and extends down at a 90° angle to the frame 1. One each of the other member 14 is attached half way down between the frame 1 and the floor on each of the two legs 2 at the foot of the frame 1 and extends outward horizontally from the leg 2 and attaches to the other member 13 at a 90° angle.

What is claimed:

1. In a toddler bed incorporating the spring and mattress components from a conventional baby crib, the combination comprising:

(a) a conventional rigid rectangular baby crib spring structure;

(b) a rectangular frame closely enclosing and supporting said spring structure including two side members, two end members each having a length, said end members removably connected to said side members to form a rectangle, four legs respectively connected to each corner of said rectangular frame, and four cross brackets with each cross bracket of said cross brackets being connected diagonally across each corner of said rectangular frame to serve as a diagonal support for each corner of said crib spring structure and to serve as diagonal bracing for said rectangular frame;

(c) a plurality of stabilizing bracket means connected to said side members and to said end members around the periphery of said rectangular frame and supporting said spring structure downwardly into close supporting contact with said cross brackets;

(d) a pair of side guard rail means of length less than said side members of said frame connected to extend vertically along said side members from one end of said frame;

(e) a pair of end guard rail means of length substantially the same as said end members of said frame and connected to extend vertically along the length of said end members;

(f) said side guard rail means and said end guard rail means cooperating to form a safety enclosure about said frame with two access spaces for a toddler to enter and leave said toddler's bed at one end of said bed; and (g) two horizontal step means respectively connected to said side members and to two of said legs under said two access spaces to provide a child with the help of a step when entering said bed through either one of said access spaces.

* * * * *